US007926882B2

(12) United States Patent
Szukiewicz

(10) Patent No.: US 7,926,882 B2
(45) Date of Patent: Apr. 19, 2011

(54) ICE GROOVING DEVICE AND METHOD

(75) Inventor: John Szukiewicz, Selkirk (CA)

(73) Assignee: 5776954 Manitoba Ltd., Selkirk, Manitoba (CA)

( * ) Notice: Subject to any disclaimer, the term of this patent is extended or adjusted under 35 U.S.C. 154(b) by 273 days.

(21) Appl. No.: 12/233,791

(22) Filed: Sep. 19, 2008

(65) Prior Publication Data

US 2009/0236898 A1 Sep. 24, 2009

Related U.S. Application Data

(60) Provisional application No. 61/037,515, filed on Mar. 18, 2008.

(51) Int. Cl.
*E02B 15/02* (2006.01)

(52) U.S. Cl. ..... 299/24; 299/41.1

(58) Field of Classification Search ..... 299/41.1, 299/24, 25, 27, 28

See application file for complete search history.

(56) References Cited

U.S. PATENT DOCUMENTS

| | | | | | |
|---|---|---|---|---|---|
| 513,708 | A | * | 1/1894 | Henderson | 299/41.1 |
| 1,307,524 | A | * | 6/1919 | Trebert | 299/27 |
| 1,480,450 | A | * | 1/1924 | Keyser | 299/27 |
| 3,675,972 | A | * | 7/1972 | Slomito | 299/41.1 |
| 4,173,836 | A | * | 11/1979 | Paurat | 37/348 |

* cited by examiner

*Primary Examiner* — John Kreck

(74) *Attorney, Agent, or Firm* — Ryan W. Dupuis; Kyle R. Satterthwaite; Ade & Company Inc.

(57) ABSTRACT

A groove is formed in a body of ice using a milling cutter to form lines of weakness for breaking up the body of ice. The shaft of the milling cutter is arranged to be supported in an upright orientation such that the shaft extends through a surface of the body of ice into the body of ice. Rotating the shaft as the milling cutter is displaced along the surface forms a groove which can follow a variable path to follow natural obstacles when cutting across a body of ice on a natural body of water for example. The ice milling cutter is compact and therefore safer to use on sheets of ice as compared to heavy equipment conventionally used for breaking up ice.

20 Claims, 5 Drawing Sheets

ICE GROOVING DEVICE AND METHOD

This claims the benefit under 35 U.S.C. 119(e) of U.S. provisional application Ser. No. 61/037,515, filed Mar. 18, 2008.

FIELD OF THE INVENTION

The present invention relates to the formation of a groove in a body of ice for example in a sheet of ice spanning a body of water such as a river to assist in ice break up.

BACKGROUND

In many climates it is common for ice to form on the surface of lakes and rivers and the like during winter months. In the spring, the formed ice melts unevenly such that the ice in some regions breaks up faster than others. One particular problem can occur when ice and snow melts in one region but thicker ice upstream forms a dam resulting in flooding in surrounding regions due to the inability of the ice to be broken up more quickly. Accordingly it is desirable to assist in breaking up ice during spring thaw across various bodies of water to avoid flooding.

Some proposed solutions to assist in breaking up ice more quickly on rivers and the like involves the use of compounds to assist in melting the ice, however such compounds including chemicals and salts and the like can result in considerable environmental damage.

Some other prior art proposed solutions to assist in breaking up ice involve use of a circular saw to forms lines of weakness in a body of ice as well as the use of a chain cutter. In each instance a very large machine is required relative to the size of the groove being formed in the ice. The resulting mechanisms are therefore very costly to build and repair if damaged. Furthermore known attempts to form lines of weakness in the form of grooves in ice using circular or chain type saws is very slow and cumbersome, requiring significant amounts of input power to drive the saws. Also, the large cumbersome shape of known circular or chain saws being supported in a generally fixed plane requires a fixed linear path to be followed when forming grooves in ice.

SUMMARY OF THE INVENTION

According to one aspect of the invention there is provided a method of forming a groove in a body of ice, the method comprising:

providing a milling cutter comprising an elongate shaft and at least one blade extending generally radially outward from the shaft;

rotating the shaft and said at least one blade supported on the shaft about a longitudinal axis of the shaft;

supporting the longitudinal axis of the shaft in an upright orientation such that the shaft extends through a surface of the body of ice into the body of ice;

displacing the milling cutter along the surface in a working direction with the shaft rotating about the longitudinal axis and extending into the body of ice so as to form a groove in the body of ice.

According to a second aspect of the present invention there is provided a device for forming a groove in a body of ice, the device comprising:

a frame arranged to be supported for movement in a working direction along a surface of the body of ice;

a milling cutter comprising an elongate shaft and at least one blade extending generally radially outward from the shaft;

the milling cutter being arranged to be supported on the frame for rotation about a longitudinal axis of the shaft such that the shaft extends through the surface of the body of ice into the body of ice as the shaft is rotated and displaced in the working direction so as to form a groove in the body of ice.

According to the present invention, a milling cutter has surprisingly been found to be effective at cutting through ice in a manner which is quick, using minimal power requirements as compared to prior art configurations and in a mechanism which is relatively compact and more readily transported than prior art attempts using circular or chain type cutting saws. The use of a milling cutter in addition to being particularly quick and efficient compared to prior art arrangements also has the advantage of permitting grooves to be formed in a body of ice along a variable path in any direction to follow natural obstacles when cutting across a body of ice on a natural body of water for example. Furthermore, the more compact design is accordingly much safer to use on sheets of ice during the formation of lines of weakness therein due to the reduced mass of the equipment required to drive the cutter. In a preferred arrangement, the milling cutter can be operated for rotation about a longitudinal axis extending upwardly and forwardly into the direction of travel such that the cutter is well oriented for riding over various forms of debris which maybe present in the ice rather than causing considerable damage to the cutting blades as in proposed prior art configurations using circular or chain saws.

Preferably the longitudinal axis of the shaft is supported to extend upwardly and forwardly into the working direction.

The longitudinal axis of the shaft may further be supported in a vertical plane of the working direction.

Orientation of the longitudinal axis of the shaft is preferably adjustable about a lateral pivot axis for adjusting inclination of the longitudinal axis of the shaft.

The method may further include: providing a frame arranged for supporting the milling cutter on a driving vehicle for displacing the milling cutter along the surface in the working direction; pivotally adjusting inclination of the longitudinal axis of the shaft relative to the frame; and adjusting the height of the frame relative to the driving vehicle.

The method may also include: providing a drive for driving rotation of the milling cutter about the longitudinal axis of the shaft; supporting the drive above the surface of the body of ice; and supporting the milling cutter to project from the drive to a free end projecting into the body of ice.

There may be provided a scraper member arranged to be engaged on the surface of the body of ice ahead of the milling cutter in alignment therewith in the working direction.

The milling cutter may be formed from a plurality of modular sections arranged for abutment in series with one another along the longitudinal axis of the shaft, in which adjusting a length of the milling cutter along the longitudinal axis of the shaft thereof is accomplished by selecting a prescribed number of modular sections to be supported on the shaft.

The modular sections may be connected in driving engagement with one another by locating projections at the inner end of each modular section which are matingly received within corresponding sockets in an outer end of an adjacent one of the modular sections.

In one embodiment, rotation of the milling cutter is driven by a power take off shaft of a driving vehicle upon which the milling cutter is supported. In this instance, the milling cutter is typically driven to rotate at a greater RPM than the power take off shaft of the driving vehicle, for example a rate of rotation of near 1000 RPM or greater.

Alternatively, rotation of the milling cutter may be driven by a hydraulic motor driven by a hydraulic system of a driving vehicle upon which the milling cutter is supported.

When the groove is formed in a body of ice spanning a natural body of water, the method preferably includes selecting a depth of the groove formed in the body of ice to be at least half a thickness of a body of ice.

A plurality of milling cutters may be supported on a common frame parallel and spaced apart from one another so as to be arranged to form a plurality of parallel and spaced apart grooves in the body of ice.

In one embodiment there may be provided a plurality of cutter blades on the milling cutter in which each blade extends a full length of the cutter in a generally helical pattern which extends less than one revolution about a circumference of a cutter for each foot of length of the cutter along the longitudinal axis of the shaft.

Alternatively, said at least one blade may comprise a plurality of cutting members projecting radially outward from the shaft at spaced apart positions from one another in both a circumferential direction and a longitudinal direction of the shaft.

Preferably each cutting member extends radially outward from an inner end threadably received within a respective socket on the shaft to an outer end supporting a pointed carbide tip thereon so as to be arranged for cutting the ice.

Some embodiments of the invention will now be described in conjunction with the accompanying drawings in which:

BRIEF DESCRIPTION OF THE DRAWINGS

In the drawings like characters of reference indicate corresponding parts in the different figures.

DETAILED DESCRIPTION

Figure 1:
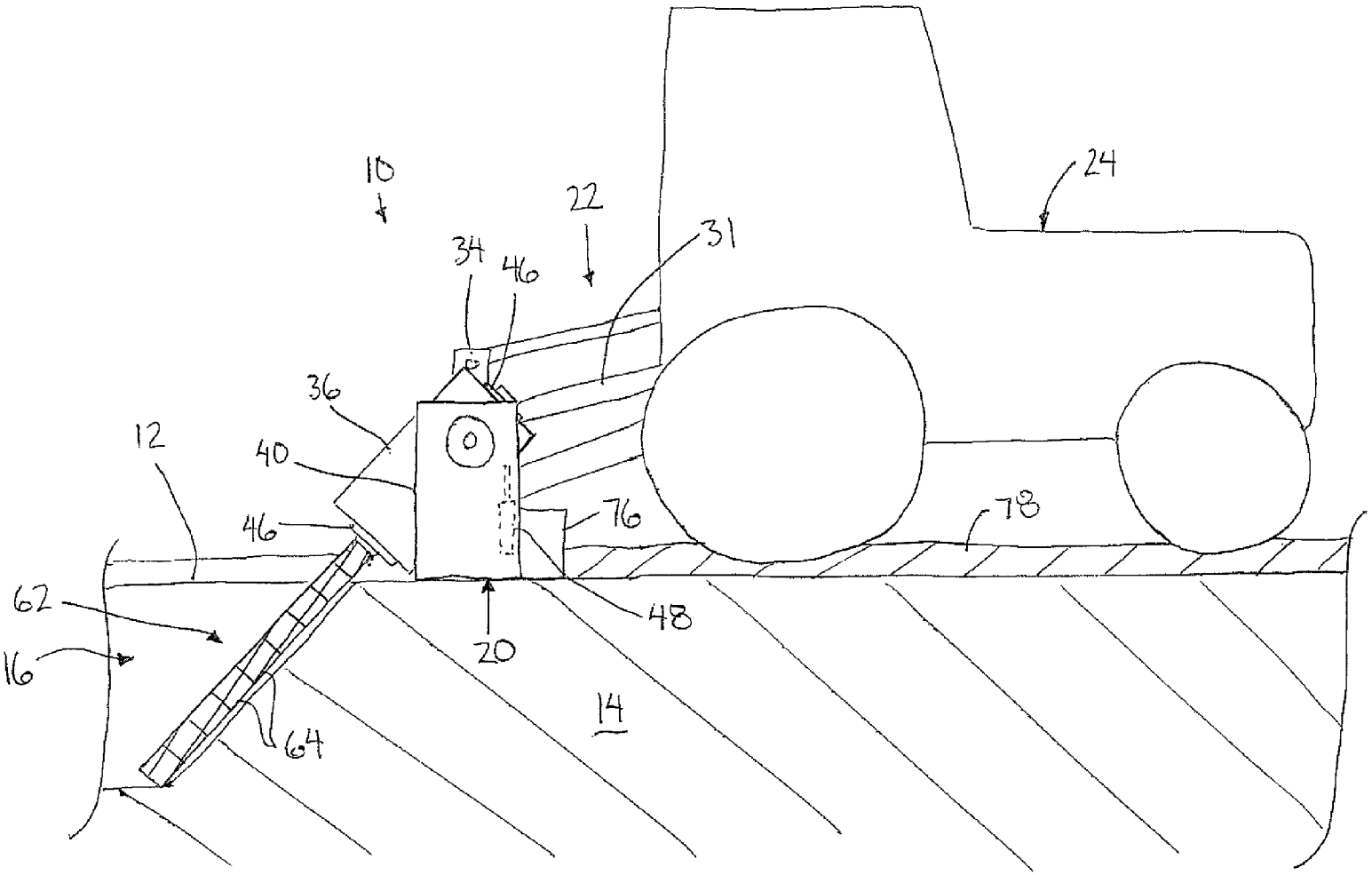
FIG. 1 is a side elevational view of the ice grooving device shown supported on a towing vehicle.
Figure 3:
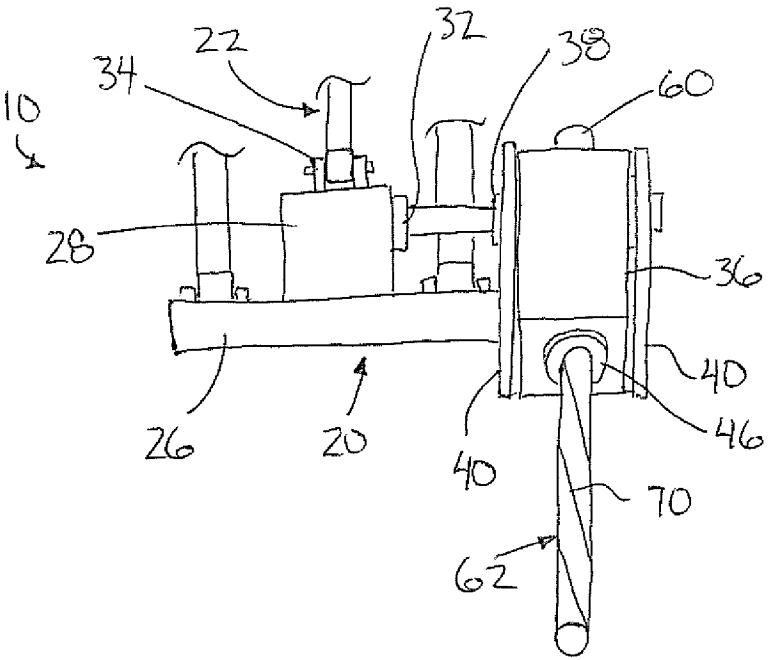
FIG. 3 is a rear elevational view of the device.
Figure 2:
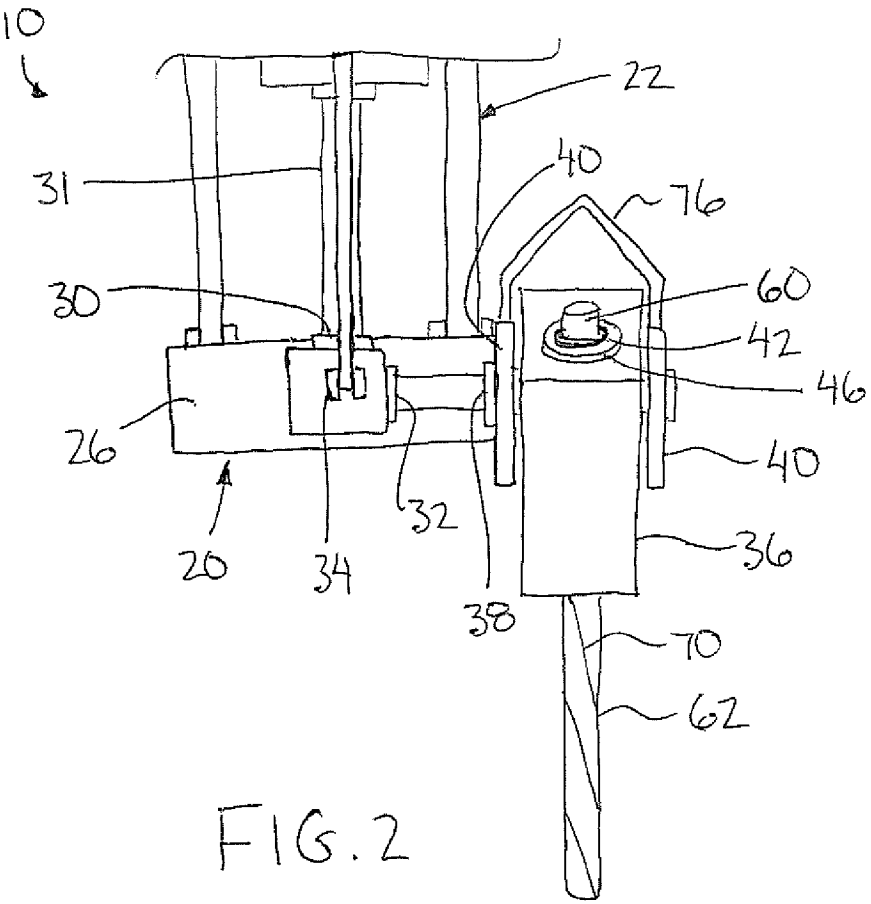
FIG. 2 is a top plan view of the device.
Figure 4:
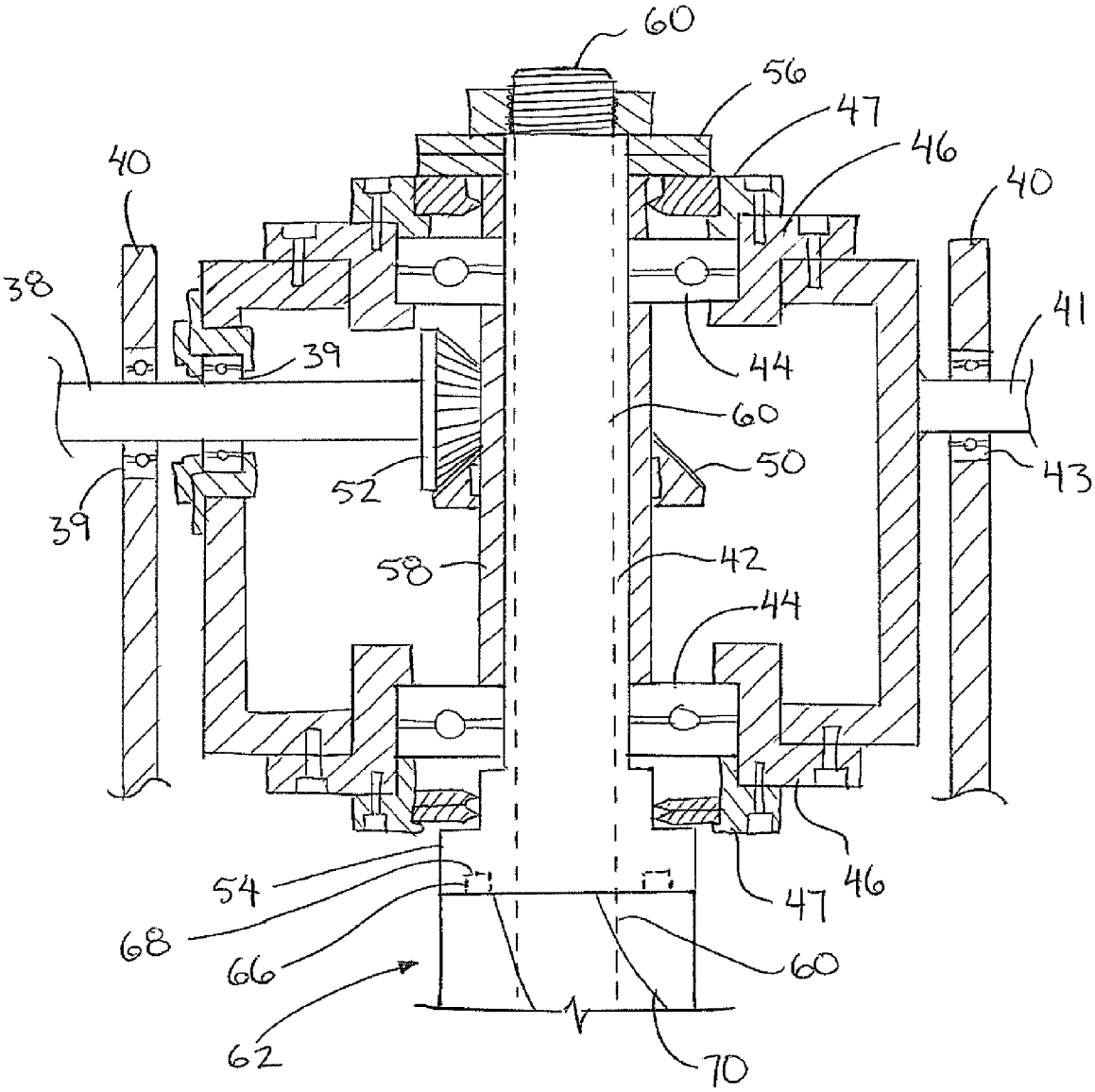
FIG. 4 is a sectional view of the internal components of the second gear box.
Figure 5:
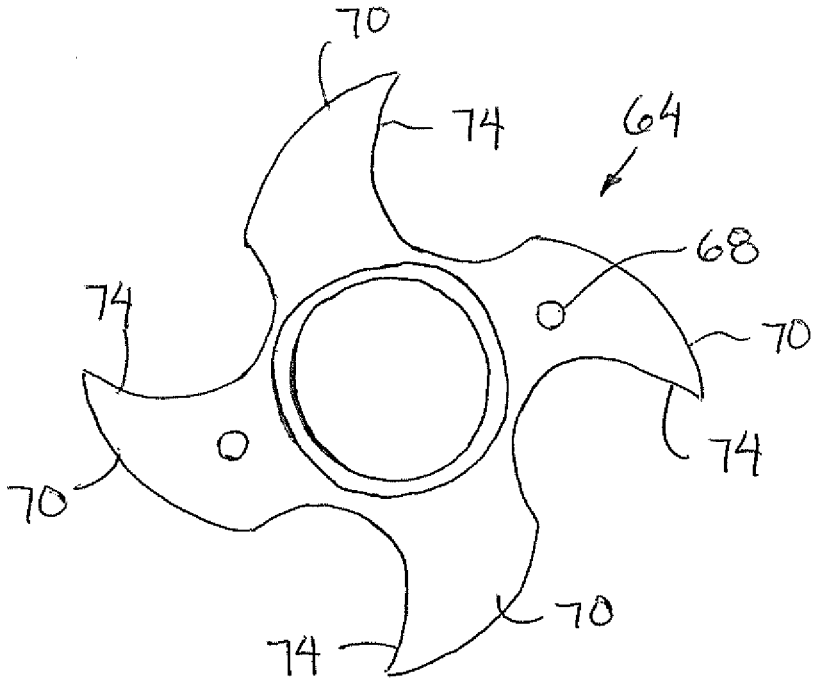
FIG. 5 is an end view of one of the cutter sections.
Figure 6:
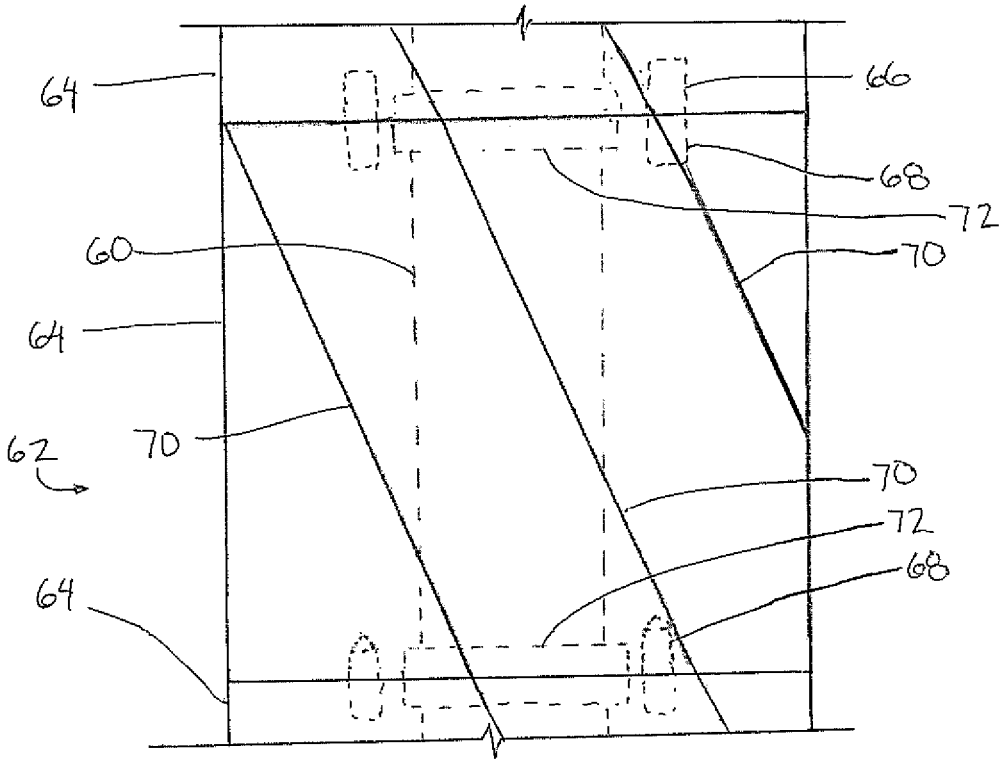
FIG. 6 is an elevational view of the cutter sections.

Referring to the accompanying figures there is illustrated an ice grooving device generally indicated by reference numeral 10. The device 10 is suited for being displaced along a surface 12 of a body 14 of ice for forming a groove 16 in the ice extending in the working direction of the device. Accordingly the device is well suited to forming grooves which define lines of weakness in the ice to assist in breaking up ice on natural bodies of water including rivers and lakes and the like. Grooves can be formed which extend down into the body of ice from the surface thereof greater than half of the thickness of ice for example in the range of many feet according to the illustrated embodiment.

The device 10 includes a frame 20 which according to a preferred embodiment is shown arranged for attachment to a three point hitch 22 of a towing vehicle in the form of a tractor 24. The frame includes a cross bar 24 which is suitably arranged for connection to the two drawbar connections of the three point hitch 22 such that the cross bar 24 spans horizontally and perpendicularly to the working direction of the vehicle in use.

A first gear box 28 is supported above the cross bar 26 of the frame in which a housing of the gear box is fixed to the frame. The first gear box includes an input shaft 30 at a forward end thereof which is suitably arranged for connection to a power take off shaft 32 of the towing vehicle. An output shaft 32 of the first gear box 28 projects laterally outwardly from one side of the gear box to be oriented generally horizontally and perpendicularly to the input 30 oriented in the forward working direction. The input and output shafts are geared to one another within the first gear box at a 2 to 1 ratio so that the output shaft is rotated at approximately 1080 RPM (revolutions per minute) when the power take off shaft 31 of the towing vehicle comprises a conventional tractor PTO rotating at 540 RPM.

A hitch connector 34 is fixed onto the frame above the first gear box 28 for connection to the upper hitching arm of the three point hitch 22 of the towing vehicle. The hitch connector 34 above the cross bar 26 and the two opposed ends of the cross bar thus form the three connection points of the three point hitch 22. Height of the frame 20 relative to the ground is thus adjustable using the conventional three point hitch controls on the tractor for raising and lowering the frame relative to the ground.

A second gear box 36 is supported at one end of the cross bar 26 of the frame so as to be laterally offset relative to the first gear box 28. The output shaft 32 of the first cross bar extends horizontally in a lateral direction so as to be connected directly to the input shaft 38 of the second gear box for driving the input of the second gear box.

The frame includes two vertical plate members 40 extending upwardly from the cross bar 26 parallel and spaced apart from one another and oriented parallel to the forward working direction of the vehicle. The second gear box 36 is supported between the two vertical plate members for relative pivotal movement such that the second gear box 36 is pivoted relative to the frame 20 of the device about a horizontal axis extending perpendicularly to the forward working direction in a lateral direction along a longitudinal axis of the output shaft 32 connected between the first and second gear boxes.

An inner side of the second gear box 36 which receives the input shaft 38 therethrough is supported on the respective plate member 40 for relative pivotal movement about the horizontal axis by the input shaft 38. Suitable bearings 39 in the inner side wall of the second gear box and the plate member 40 support the second gear box on the input shaft for relative rotation and support the input shaft on the inner one of the plate members 40 for relative rotation respectively. The input shaft 38 thus serves to pivotally support the inner side of the second gear box on the innermost vertical plate member 40.

An outer side of the second gear box 36 includes an axle member 41 fixedly supported thereon to project outwardly along the horizontal pivot axis of the second gear box 36. The axle member 41 is received through a suitable bearing 43 mounted on the outer one of the plate members 40 to support the outer side of the gearbox for relative pivotal movement on the outermost vertical plate member 40 about the horizontal pivot axis.

The second gear box generally comprises a housing which is generally rectangular and elongate in a longitudinal direction of a primary shaft 42 of the second gear box 36. The shaft 42 is supported at opposing ends of the gear box housing by respective bearings 44 spaced apart from one another along the shaft at axially spaced positions at opposing ends of the second gear box housing.

A suitable end cap 46 is secured to each of the two opposing ends of the gear box housing threaded fasteners for supporting the bearings 44 relative to the housing which in turn supports the primary shaft extending through the gearbox for relative rotation therebetween about the longitudinal axis of the shaft.

A sealing cap 47 is secured by threaded fasteners to an outer side of each of the end caps 46 to locate an annular sealing member about the shaft for sealing between the second gear box housing and the shaft extending through the second gear box housing.

The shaft 42 pivots with the gear box housing about the axis of the output shaft 32 of the first gear box relative to the frame to adjust the inclination of the primary output shaft 42 extending downwardly and rearwardly relative to the towing vehicle.

A hydraulic actuator 48 is coupled between the second gear box and a portion of the frame 20 therebelow. The hydraulic actuator is coupled to the second gear box at a location spaced radially outward from the axis of pivotal movement of the housing relative to the frame such that extension and contraction of the actuator controls the angular inclination of the second gear box relative to the frame about the pivot axis thereof at the axis of the output shaft 32 of the first gear box.

The primary shaft 42 extending through the second gear box includes a driven bevel gear 50 fixed thereon by a suitable key and mating keyway such that the gear rotates with the primary shaft 42 about the longitudinal axis thereof. Similarly a driving bevel gear 52 is fixed on the end of the output shaft 32 of the first gear box which forms the input shaft 38 of the second gearbox and which terminates within the housing of the second gear box in mating engagement with the driven bevel gear 50.

A suitable flange 54 is formed at a rear bottom end of the primary shaft 42 for engagement at an outer side of a bearing assembly 44 at the end of the gear box. Opposite the flange there is provided a suitable locking nut 56 such that when the locking nut 56 is secured to the primary shaft 42 opposite the flange 54, the opposed bearings 44 at opposed ends of the gear box housing are contained at spaced positions along the shaft between the flange and locking nut 56. A sleeve 58 is provided concentrically about the primary shaft 42 between the bearings 44 at opposing ends thereof to provide support to maintain the spacing in the axial direction between the bearings when the locking nut 56 is threadably tightened towards the opposing flange 54 on the shaft.

The primary shaft 42 comprises a hollow tube having a concentric passage extending therethrough which is suitably arranged for receiving a secondary shaft 60 extending therethrough. The secondary shaft 60 is supported at a first end at a top inner end of the primary shaft 42 by a respective nut to prevent relative sliding in the axial direction. The secondary shaft 60 extends fully through the primary shaft 42 to extend beyond the rear bottom end or second end thereof beyond the end of the gear box to a free outer end which supports a milling cutter 62 thereon.

The milling cutter 62 comprises a plurality of modular sections 64 which can be assembled end to end in series with one another to adjust the overall length of the cutter 62 in an axial direction thereof about which the cutter rotates by selecting the number of modular sections 64 to be stacked along the shaft. The length of the secondary shaft 60 is accordingly adjusted by selecting a shaft length which corresponds to the number of section 64 selected such that the shaft does not project outwardly beyond the free end of the cutter 62.

Each section 64 of the cutter is a tubular member which is slidably received onto the secondary shaft 60. Each section 64 includes a plurality of projections 64 projecting upwardly from an inner top end thereof for mating engagement with corresponding sockets 68 formed in the outer bottom end of an adjacent one of the modular sections 64 of identical configuration. The projections are mounted in corresponding sockets within each section such that mounting of the projections in the opposing end of the section body permits the body of the section to be reversed if desired. Similar mating sockets 68 are provided in the outer bottom end of the flange 54 at the second (bottom) end of the primary shaft such that the rotation of the primary shaft transfers drive through the mating projections 66 and sockets 68 for driving rotation of the sections 64 of the cutter about the longitudinal axis of the shafts extending through the gear box.

The milling cutter includes a plurality of blades 70 formed in sections corresponding to the sections 64 of the cutter. Four identical blades are provided which extend generally radially outward from the axis of rotation of the cutter along a full length of the cutter in a generally helical pattern about the body of the cutter. Each blade follows a helical pattern which extends only partway around the circumference of the cutter along a length of several feet thereof. Within each section 64 the socket 68 at the bottom side thereof or angularly offset about the axis of rotation relative to the corresponding projection 66 in the topside by the same amount of the helical offset about the circumference of the cutter section from top to bottom thereof so that when assembled the sections of the blades 70 are all continuous with one another to form a set of continuous blades 70 extending along the length of the assembled cutter.

Each section 64 of the cutter includes a counter bore 72 formed concentrically in the bottom side thereof having a greater radial dimension than the through tubular passage in the sections that receives the shaft 60 so as to be arranged to receive the bolt head at one end of the secondary shaft 60 therein when the cutter is assembled. By arranging the secondary shaft 60 to comprise a bolt, the head is received within the counter bore at the bottom of the lowermost one of the sections 64 of the milling cutter while the opposing threaded end of the secondary shaft 60 extends beyond the forward top end (first end) of the gear box and primary shaft received therethrough for securement of a suitable locking nut which provides a clamping force to maintain the projections of each section 64 of the cutter engaged within the corresponding mating sockets thereabove for transferring drive about the long axis of the cutter from the primary shaft in the gear box through each of the adjacent sections 64 of the milling cutter. By recessing the head of the secondary shaft 60 completely into the bottom side of the lowermost one of the sections of the milling cutter, the end of the milling cutter is completely flat and freely unsupported for ease of penetration into a body of ice within which a groove is to be formed.

Each of the blades includes a leading face 74 which is sloped inwardly and rearwardly away from a direction of rotation relative to a radial segment extending between the centre of the cutter and the tip of the blade. Accordingly the tip of each blade forms a point having a narrow acute angle which points or faces into the direction of rotation.

The device 10 further includes a shoe 76 formed on the frame to extend downwardly below the cross bar 26 in alignment in the working direction with the milling cutter. The shoe generally comprises a V shaped wall formed by two upright plates joined at an apex and arranged to be joined between and to project forwardly from the two side plate members between which the secondary gear box is mounted. The shoe 76 forms a plough or scraper member which is ahead of the milling cutter in the forward working direction of the vehicle for scraping the surface of the body of ice clear and for positioning the milling cutting relative to the surface of the body of ice. The width of the shoe is at least equal to or greater than the width of the cutter for clearing a path in snow 78 resting above a body of ice in which a groove is to be formed.

Figure 7:
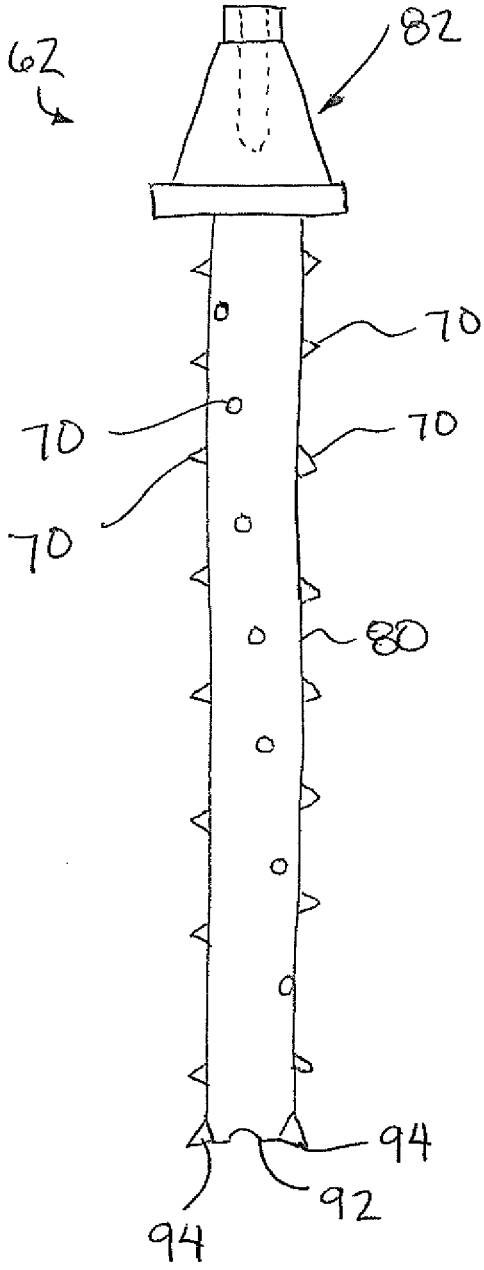
FIG. 7 is an elevational view of an alternative embodiment of the shaft of the milling cutter.
Figure 8:
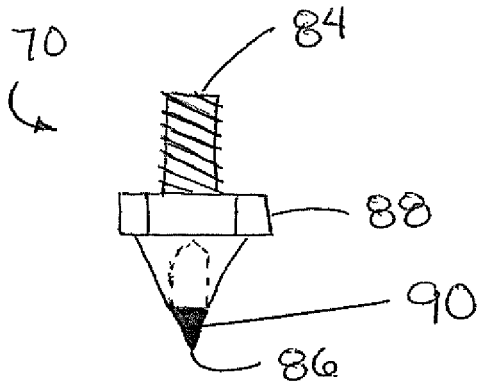
FIG. 8 is an elevational view of one of the cutting members supported on the shaft according to FIG. 7.

Turning now to FIGS. 7 and 8, a further embodiment of the milling cutter 62 is illustrated in which the cutter comprises a single integral shaft member 80 of selected length corresponding to the desired depth of cut in the body of ice. The shaft member 80 includes a mounting end 82 comprising a flange arranged to be mounted at the end of the primary shaft 42 extending through the gear box. The flange is arranged for abutment against the bearings and seal on the outer side of the gear box.

According to the embodiment of shown in FIGS. 7 and 8, the shaft member 80 includes a plurality of blades 70 each comprising a respective cutting member suitably arranged for chipping the ice. The cutting members are mounted onto the shaft member 80 to project generally radially outward therefrom from respective mounting positions arranged in longitudinally extending rows along the shaft member. The cutting members are spaced apart in the longitudinal direction within each row, offset from the cutting members of adjacent rows in the longitudinal direction. The rows are also spaced circumferentially from one another about the shaft member. Each of the rows of cutting members is shown in FIG. 7 to follow a generally spiral or helical pattern about the shaft member 80.

Each cutting member 70 extends generally radially outward from the shaft from an inner end 84 arranged to be threaded into a respective socket formed in the shaft member to an outer end 86. An intermediate portion 88 between the inner end and the outer end is generally hexagonal in cross section to permit clamping by suitable tools for tightening the threaded connection between the inner end of the cutting member and the shaft member. The outer end of the cutting member supports a pointed carbide tip 90 thereon which includes a stem portion received within the body of the cutting member for supporting the tip 90 on the cutting member body.

In the event that any of the pointed carbide tips 90 become worn or broken, the body of the cutting member is simply removed from the shaft member by unthreading the connection therebetween for replacement with a different cutting member 70. The location of the cutting members along the shaft are positioned such that each cutting member is offset in the circumferential direction from any other cutting members on the shaft. In this manner the load of the cutting members cutting the ice is distributed over a greater period of time by contacting the cutting members with the ice sequentially instead of simultaneously.

At the free end 92 of the shaft, a plurality of cutting members are supported to extend radially outward at an outward inclination in the direction of the longitudinal axis of rotation of the shaft so that the pointed tips 90 of the outermost cutting members 94 project outward in the axial direction beyond the end of the shaft for forming the terminal end of the bore or groove formed in the ice by the cutter.

In a preferred arrangement, the shaft of the cutter 62 is driven to rotate about its respective longitudinal axis directly by a hydraulic motor which in turn is arranged to be driven by a hydraulic system of a driving vehicle upon which the milling cutter is supported. A hydraulic motor permits variable speed control of the cutter according to different ice conditions within which the groove is formed. In this instance, the cutter remains supported on a frame for pivotal movement about a generally horizontal axis oriented perpendicularly to the forward working direction so as to be supported in a working position with the shaft of the cutter extending downwardly and rearwardly at an incline into the body of ice as in the first embodiment.

In further embodiments, the angular inclination of the cutter about the horizontal pivot axis may be controlled by a suitable gear motor or other rotary control other than the linear actuator 48 described in the first embodiment. Use of a gear motor permits more accurate positional control of the milling cutter about the horizontal pivot axis.

In use the frame 20 of the device is supported on a towing vehicle for displacement in a forward working direction of the vehicle. The milling cutter is supported for rotation on the frame about a longitudinal axis of the secondary shaft extending through the milling cutter and supporting the various sections of the cutter thereon. The cutter is supported to initially extend generally rearward from the secondary gear box upon which it is supported at a location spaced above a surface of the ice by raising the frame relative to the ground using the three point hitch controls of the towing vehicle. The frame can then be lowered prior to use of the cutter for forming a groove using the three point hitch control of the vehicle until the shoe 76 on the frame engages the surface of the ice for clearing the snow therefrom.

Using the PTO of the towing vehicle in one embodiment, or a hydraulic motor in another embodiment, the first gear box can be driven to rotate, which in turn drives the input of the second gear box for rotating the milling cutter thereon. Due to the ratio of the first gear box, the milling cutter is rotated at twice the RPM of the 540 RPM powered take off of the towing vehicle when using a PTO.

Prior to operation of the milling cutter, the overall length of the cutter is selected by selecting the number of sections to be assembled together and/or a length of the secondary shaft extending through the second gear box is selected. When forming lines of weakness for assisting in breaking up ice on a body of water, it is desirable to form a groove in the ice which may extend half a depth of the ice or greater. For example in a 6 foot thick sheet of ice, a 4 foot deep groove or trench may be formed by the milling cutter by selecting a cutter having a length near 5 or 6 feet for forming a 4 foot deep groove due to the sloped inclination of the milling cutter in operation.

When ready to form a groove, the rotating cutter is lowered into the body of ice across the surface thereof using the hydraulic actuator coupled between the second gear box and the frame of the device to in turn pivot the second gear box and the cutter thereon about the lateral axis extending through the second gear box. The milling cutter is operated at an inclination extending downwardly and rearwardly across the surface of the ice and penetrating into the body of ice at an angle which may be up to 80 degrees from horizontal or 10 degrees from vertical. Displacing the vehicle forwardly in the working direction during rotation of the milling cutter forms a groove in the ice having a width in the order of a few inches for example when the diameter of the cutter is approximately a few inches. Due to the side cutting configuration of a milling cutter, the vehicle can be displaced in any direction and along any path while the milling cutter continues to cut a suitable groove following the vehicle. Accordingly the device 10 is well suited for forming lines of weakness in a body of ice spanning a body of water such as a river for example to assist in breaking up the ice more quickly during spring thaw so as to resume flow of the river and prevent flooding in surrounding environments.

In further embodiments, the milling cutter may comprise up to 6 blades extending generally helically along a length of the cutter. Greater RPM may be desired when more blades are provided.

The frame of the device may also be modified to be driven across a surface of the ice by various means. In some embodiments, the cutter may be integrally supported on a self propelled chassis that an operator can walk behind. Also, the frame may be supported on various different types of vehicles by providing suitable brackets where required. In one embodiment, a plurality of cutters may be supported at staggered locations ahead of the chassis of an ice breaking marine vessel having a reinforced hull for breaking ice.

Power for driving rotation of the milling cutter may be derived from a motor which commonly propels movement of the frame in the working direction or by an auxiliary motor. Suitable motors include hydraulic motors, electric motors or internal combustion engines for driving the cutter directly or through a power take off. The power requirements will vary depending upon the blade configuration, desired speed in the working direction and the depth of the cut into the ice.

For deeper grooves, the bottom end of the milling cutter may be supported by an auxiliary arm extending along a rear side of the cutter between the bottom end and the frame. In alternative arrangements, there may be provided a pair of milling cutters of different length which are supported in alignment with one another in the forward working direction such that a longer on of the cutters follows in the path of a shorter one of the cutters to deepen the cut already made by the shorter cutter. In this instance, the two cutters are preferably arranged to counter rotate.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A method of forming a groove in a body of ice, the method comprising:

providing a milling cutter comprising an elongate shaft and at least one blade extending generally radially from the shaft;

rotating the shaft and said at least one blade supported on the shaft about a longitudinal axis of the shaft;

selecting a prescribed downward and rearward inclination of the longitudinal axis of the shaft;

supporting the longitudinal axis of the shaft such that the longitudinal axis of the shaft extends in a generally vertical plane of the working direction at the prescribed downward and rearward inclination through a surface of the body of ice into the body of ice; and displacing the milling cutter along the surface in a forward working direction with the shaft rotating about the longitudinal axis and extending into the body of ice at the prescribed downward and rearward inclination so as to form a groove in the body of ice.

2. The method according to claim 1 including:

providing a frame arranged for supporting the milling cutter on a driving vehicle such that the prescribed downward and rearward inclination is adjustable about a lateral pivot axis;

providing an actuator on the frame arranged to adjust the prescribed downward and rearward inclination; and pivotally adjusting orientation of the longitudinal axis of the shaft about the lateral pivot axis using the actuator.

3. The method according to claim 1 including:

providing a frame arranged for supporting the milling cutter on a driving vehicle for displacing the milling cutter along the surface in the working direction;

pivotally adjusting inclination of the longitudinal axis of the shaft relative to the frame; and adjusting the height of the frame relative to the driving vehicle.

4. The method according to claim 1 including:

providing a drive for driving rotation of the milling cutter about the longitudinal axis of the shaft;

supporting the drive above the surface of the body of ice; and supporting the milling cutter to project from the drive to a free end projecting into the body of ice.

5. The method according to claim 1 including providing a scraper member and engaging the scraper member on the surface of the body of ice ahead of the milling cutter in alignment therewith in the working direction.

6. The method according to claim 1 including forming the milling cutter from a plurality of modular sections arranged for abutment in series with one another along the longitudinal axis of the shaft and adjusting a length of the milling cutter along the longitudinal axis of the shaft thereof by selecting a prescribed number of modular sections to be supported on the shaft.

7. The method according to claim 6 including connecting the modular sections in driving engagement with one another by locating projections at the inner end of each modular section which are matingly received within corresponding sockets in an outer end of an adjacent one of the modular sections.

8. The method according to claim 1 including driving rotation of the milling cutter by a power take off shaft of a driving vehicle upon which the milling cutter is supported.

9. The method according to claim 8 wherein the milling cutter is driven to rotate at a greater RPM than the power take off shaft of the driving vehicle.

10. The method according to claim 1 including providing a gear box coupling the milling cutter to a power take off shaft such that the milling cutter is rotated at a rate of rotation of near 1000 RPM or greater.

11. A method of forming a groove in a body of ice, the method comprising:

providing a milling cutter comprising an elongate shaft and a plurality of cutter blades extending generally radially from the shaft;

arranging each of the plurality of cutter blades on the milling cutter such that each blade extends a full length of the cutter in a generally helical pattern which extends less than one revolution about a circumference of a cutter for each foot of length of the cutter along the longitudinal axis of the shaft;

rotating the shaft and said at least one blade supported on the shaft about a longitudinal axis of the shaft;

supporting the longitudinal axis of the shaft in an upright orientation such that the shaft extends through a surface of the body of ice into the body of ice; and displacing the milling cutter along the surface in a working direction with the shaft rotating about the longitudinal axis and extending into the body of ice so as to form a groove in the body of ice.

12. The method according to claim 1 including forming a groove in a body of ice spanning a natural body of water and selecting a depth of the groove formed in a body of ice to be at least half a thickness of a body of ice.

13. The method according to claim 1 including providing a plurality of milling cutters supported on a common frame parallel and spaced apart from one another so as to be arranged to form a plurality of parallel and spaced apart grooves in the body of ice.

14. The method according to claim 1 including forming said at least one blade to comprise a plurality of cutting members projecting radially outward from the shaft at spaced apart positions from one another in both a circumferential direction and a longitudinal direction of the shaft and forming each cutting member to extend radially outward from an inner end threadably received within a respective socket on the shaft to an outer end arranged for cutting the ice.

15. The method according to claim 1 including forming said at least one blade to comprise a plurality of cutting members projecting radially outward from the shaft at spaced apart positions from one another in both a circumferential direction and a longitudinal direction of the shaft and forming each cutting member to extend radially outward from an inner end supported on the shaft to an outer end supporting a pointed carbide tip thereon.

16. The method according to claim 1 including driving rotation of the milling cutter by a hydraulic motor driven by a hydraulic system of a driving vehicle upon which the milling cutter is supported.

17. A device for forming a groove in a body of ice, the device comprising:

a frame arranged to be supported for movement in a working direction along a surface of the body of ice;

a milling cutter comprising an elongate shaft and at least one blade extending generally radially outward from the shaft;

the milling cutter being arranged to be supported on the frame for rotation about a longitudinal axis of the shaft such that the shaft extends through the surface of the body of ice into the body of ice as the shaft is rotated and displaced in the working direction so as to form a groove in the body of ice, said at least one blade comprising a plurality of modular sections selectively supported in abutment in series with one another along the longitudinal axis of the shaft such that a length of the milling cutter along the longitudinal axis of the shaft is arranged to be adjustable by selecting a prescribed number of modular sections to be supported on the shaft;

the modular sections being aligned with one another such that said at least one blade is continuous in a helical pattern about the longitudinal axis along a full length of the cutter across all of the modular sections abutted in series with one another.

18. The device according to claim 17 wherein said at least one blade extends a full length of the cutter in a generally helical pattern which extends less than one revolution about a circumference of a cutter for each foot of length of the cutter along the longitudinal axis of the shaft.

19. The method according to claim 1 including providing a plurality of blades on the shaft of the milling cutter, and arranging each blade such that the blade extends a full length of the cutter in a generally helical pattern about the longitudinal axis and such that each blade includes a leading face which is sloped inwardly and rearwardly away from a direction of rotation and a tip which forms a point having an acute angle which points into the direction of rotation.

20. The method according to claim 1 including:

providing a frame arranged for supporting the milling cutter on a driving vehicle such that the prescribed downward and rearward inclination is adjustable about a lateral pivot axis;

providing a gearbox housing having an input shaft at the lateral pivot axis about which the gearbox housing is pivotal relative to the frame;

supporting the shaft of the milling cutter on the gearbox housing for rotation relative to the gearbox housing about the longitudinal axis of the shaft of the cutter such that the shaft of the milling cutter defines the output shaft of the gearbox housing; and pivoting the shaft of the cutter together with the gearbox housing about the lateral pivot axis to adjust the prescribed downward and rearward inclination.

* * * * *